US010731901B2

(12) United States Patent
Thobias et al.

(10) Patent No.: US 10,731,901 B2
(45) Date of Patent: Aug. 4, 2020

(54) METHOD AND APPARATUS FOR BALANCED FLUID DISTRIBUTION IN MULTI-COMPRESSOR SYSTEMS

(71) Applicant: Lennox Industries Inc., Richardson, TX (US)

(72) Inventors: Patric Ananda Balan Thobias, Pondicherry (IN); Abdul Rehman, Chennai (IN); Rakesh Goel, Irving, TX (US); Siddarth Rajan, Dallas, TX (US)

(73) Assignee: Lennox Industries Inc., Richardson, TX (US)

( * ) Notice: Subject to any disclaimer, the term of this patent is extended or adjusted under 35 U.S.C. 154(b) by 0 days.

(21) Appl. No.: 15/464,470

(22) Filed: Mar. 21, 2017

(65) Prior Publication Data

US 2018/0274829 A1 Sep. 27, 2018

(51) Int. Cl.

| | |
|---|---|
| ***F25B 43/02*** | (2006.01) |
| ***F25B 31/00*** | (2006.01) |
| ***F25B 45/00*** | (2006.01) |
| ***F25B 41/00*** | (2006.01) |
| ***F25B 49/02*** | (2006.01) |

(52) U.S. Cl.

CPC ..... *F25B 31/00* (2013.01); *F25B 41/003* (2013.01); *F25B 45/00* (2013.01); *F25B 49/02* (2013.01); *F25B 2400/075* (2013.01); *F25B 2500/19* (2013.01); *F25B 2500/26* (2013.01); *F25B 2600/05* (2013.01); *F25B 2700/04* (2013.01)

(58) Field of Classification Search

CPC ..... F25B 31/00; F25B 41/003; F25B 45/00; F25B 2400/075; F25B 49/02; F25B 41/043; F25B 41/04; F25B 2600/025; F25B 2600/05; F25B 2500/16; F25B 2400/0751; F25B 2600/2519; F25B 31/002; F25B 2500/27; F25B 2500/19; F25B 1/10; F25B 45/26; F25B 2700/04

See application file for complete search history.

(56) References Cited

U.S. PATENT DOCUMENTS

| | | | |
|---|---|---|---|
| 2,294,552 | A | 9/1942 | Gygax |
| 3,243,101 | A | 3/1966 | Shaw |
| 3,386,262 | A | 6/1968 | Hackbart et al. |
| 3,785,169 | A | 1/1974 | Gylland, Jr. |

(Continued)

FOREIGN PATENT DOCUMENTS

| | | | |
|---|---|---|---|
| EP | 0403239 A2 | 12/1990 | |
| EP | 1120611 A1 * | 8/2001 | ..... F25B 31/004 |

OTHER PUBLICATIONS

U.S. Appl. No. 15/671,243, Berg, et al.

(Continued)

*Primary Examiner* — Henry T Crenshaw
*Assistant Examiner* — Kamran Tavakoldavani
(74) *Attorney, Agent, or Firm* — Winstead PC

(57) ABSTRACT

A compressor system includes at least two compressors. A suction equalizing tube fluidly couples the at least two compressors. A plumbing assembly fluidly couples to the first compressor and the second compressor. The plumbing assembly comprises an outlet to each compressor of the at least two compressors. A pressure differential between the at least two compressors is created so as to facilitate maintenance of a desired fluid level in the at least two compressors.

15 Claims, 6 Drawing Sheets

(56) References Cited

U.S. PATENT DOCUMENTS

| | | | | |
|---|---|---|---|---|
| 4,141,676 | A | 2/1979 | Jannen et al. | |
| 4,269,261 | A | 5/1981 | Kountz et al. | |
| 4,383,802 | A | 5/1983 | Gianni et al. | |
| 4,418,548 | A | 12/1983 | Sawyer | |
| 4,729,228 | A | 3/1988 | Johnsen | |
| 4,741,674 | A | 5/1988 | Tischer | |
| 4,750,337 | A | 6/1988 | Glamm | |
| 5,094,598 | A | 3/1992 | Amata et al. | |
| 6,186,758 | B1 * | 2/2001 | Shaw | F04C 29/0021 384/303 |
| 6,928,828 | B1 | 8/2005 | Taras et al. | |
| 6,948,916 | B2 | 9/2005 | Hebert | |
| 7,325,414 | B2 | 2/2008 | Taras et al. | |
| 7,469,555 | B2 | 12/2008 | Taras et al. | |
| 7,651,322 | B2 | 1/2010 | Shaw | |
| 8,215,122 | B2 | 7/2012 | Hyun et al. | |
| 8,408,024 | B2 | 4/2013 | Ogata et al. | |
| 8,641,395 | B2 * | 2/2014 | Nemit, Jr. | F04C 18/16 137/625.28 |
| 9,551,351 | B2 | 1/2017 | De Bernardi et al. | |
| 9,599,118 | B2 | 3/2017 | Zhou et al. | |
| 2005/0091998 | A1 | 5/2005 | Cho et al. | |
| 2006/0225445 | A1 | 10/2006 | Lifson et al. | |

OTHER PUBLICATIONS

U.S. Appl. No. 15/606,571, Goel, et al.
U.S. Appl. No. 15/464,606, Goel et al.
U.S. Appl. No. 15/824,060, Goel, et al.

* cited by examiner

| LOCATION | MALDISTRIBUTION VALUE | FLOW PATH | PRESSURE DROP ("wc) |
|---|---|---|---|
| Outlet_1 | 0.38 | Path_1 | 12.7 |
| Outlet_2 | -0.47 | Path_2 | 15.4 |
| Outlet_3 | 0.09 | Path_3 | 13.6 |

FIG. 1C

| COMPRESSOR START ORDER IN FULL LOAD | COMPRESSOR 1 LIQUID LEVEL (in) | COMPRESSOR 2 LIQUID LEVEL (in) | COMPRESSOR 3 LIQUID LEVEL (in) |
|---|---|---|---|
| 213 | 2.4 | 9 | 4.9 |
| 312 | 2.7 | 9.1 | 5 |
| 123 | 2.6 | 9.1 | 4.9 |

FIG. 1D

| LOCATION | MALDISTRIBUTION VALUE | | FLOW PATH | PRESSURE DROP ("wc) | |
|---|---|---|---|---|---|
| | BASELINE | NEW DESIGN | | BASELINE | NEW DESIGN |
| Outlet_1 | 0.25 | 0.04 | Path_1 | 12.5 | 12.7 |
| Outlet_2 | -0.33 | -0.08 | Path_2 | 22.6 | 13.1 |
| Outlet_3 | 0.08 | 0.04 | Path_3 | 16.3 | 13.0 |

METHOD AND APPARATUS FOR BALANCED FLUID DISTRIBUTION IN MULTI-COMPRESSOR SYSTEMS

CROSS-REFERENCE TO RELATED APPLICATIONS

This patent application incorporates by reference for any purpose the entire disclosure of a patent application titled METHOD AND APPARATUS FOR BALANCED FLUID DISTRIBUTION IN TANDEM-COMPRESSOR SYSTEMS, bearing Ser. No. 15/464,606 and filed concurrently herewith.

TECHNICAL FIELD

The present invention relates primarily to heating, ventilation, and air conditioning ("HVAC") systems and more particularly, but not by way of limitation, to HVAC systems having multiple compressors with balanced fluid flow between the compressors.

BACKGROUND

Compressor systems are commonly utilized in HVAC applications. Many HVAC applications utilize compressor systems that comprise two or more parallel-connected compressors. Such multi-compressor systems allow an HVAC system to operate over a larger capacity than HVAC systems utilizing a single compressor. Frequently, however, multi-compressor systems are impacted by disproportionate fluid distribution between the compressors. Such disproportionate fluid distribution results in inadequate lubrication, loss of performance, and a reduction of useful life of the individual compressors in the multi-compressor system. Many present designs utilize mechanical devices, such as flow restrictors, to regulate fluid flow to each compressor. However, these mechanical devices are subject to wear and increased expense due to maintenance.

SUMMARY

The present invention relates primarily to heating, ventilation, and air conditioning ("HVAC") systems and more particularly, but not by way of limitation, to HVAC systems having multiple compressors with balanced fluid flow between the compressors. In a first aspect, the present invention relates to a compressor system. The compressor system includes at least two compressors. A suction equalizing tube fluidly couples the at least two compressors. A plumbing assembly fluidly couples to the first compressor and the second compressor. The plumbing assembly comprises an outlet to each compressor of the at least two compressors. A pressure differential between the at least two compressors is created so as to facilitate maintenance of a desired fluid level in the at least two compressors.

In another aspect, the present invention relates to a plumbing assembly. The plumbing assembly includes an inlet tube. A first main branch is fluidly coupled to the inlet tube. A second main branch is fluidly coupled to the inlet tube. A distribution section is fluidly coupled to the first main branch and to the second main branch. The distribution section includes a first outlet, a second outlet, and a third outlet. A first flow path is defined between the inlet tube and the first outlet. A second flow path is defined between the inlet tube and the second outlet. A third flow path is defined between the inlet tube and the third outlet. A desired pressure differential between first outlet, the second outlet, and the third outlet is created.

In another aspect, the present invention relates to a method of equalizing pressure in a multi-compressor system. The method includes determining a prescribed liquid level for at least two compressors and determining a liquid-level differential between the at least two compressors. A pressure drop for the at least two compressors that corresponds to the liquid-level differences is determined. An inlet tube is coupled to a main branch. A distribution section is coupled to the main branch. At least two compressors are coupled to the distribution section through at least a first outlet and a second outlet, respectively. The first outlet defines a first flow path between an inlet and the first outlet. The second outlet defines a second flow path between the inlet and the second outlet. A pressure drop is created in the first flow path and the second flow path that facilitates maintenance of the prescribed liquid level in the at least two compressors.

BRIEF DESCRIPTION OF THE DRAWINGS

For a more complete understanding of the present invention and for further objects and advantages thereof, reference may now be had to the following description taken in conjunction with the accompanying drawings in which:

FIG. 1C is a table illustrating performance data associated with the plumbing assembly of FIG. 1B;

FIG. 1D is a table illustrating compressor fluid levels at various start conditions associated with the plumbing assembly of FIG. 1A;

DETAILED DESCRIPTION

Various embodiments of the present invention will now be described more fully with reference to the accompanying drawings. The invention may, however, be embodied in many different forms and should not be construed as limited to the embodiments set forth herein.

Figure 1A:
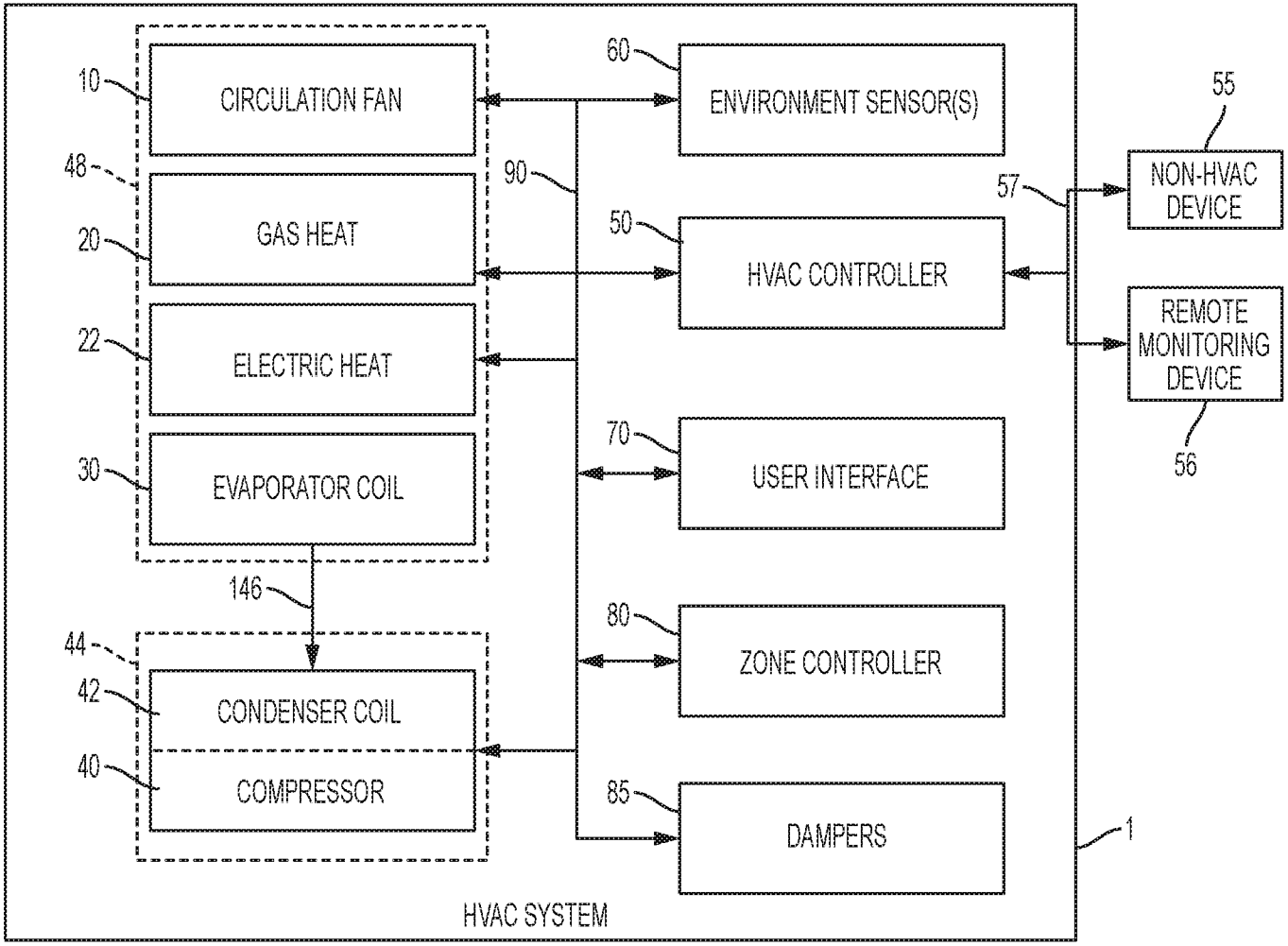
FIG. 1A is a block diagram of an HVAC system.

FIG. 1A illustrates an HVAC system 1. In a typical embodiment, the HVAC system 1 is a networked HVAC system that is configured to condition air via, for example, heating, cooling, humidifying, or dehumidifying air. The HVAC system 1 can be a residential system or a commercial system such as, for example, a roof top system. For exemplary illustration, the HVAC system 1 as illustrated in FIG. 1A includes various components; however, in other embodiments, the HVAC system 1 may include additional components that are not illustrated but typically included within HVAC systems.

The HVAC system 1 includes a variable-speed circulation fan 10, a gas heat 20, electric heat 22 typically associated with the variable-speed circulation fan 10, and a refrigerant evaporator coil 30, also typically associated with the variable-speed circulation fan 10. The variable-speed circulation fan 10, the gas heat 20, the electric heat 22, and the refrigerant evaporator coil 30 are collectively referred to as an "indoor unit" 48. In a typical embodiment, the indoor unit 48 is located within, or in close proximity to, an enclosed space. The HVAC system 1 also includes a variable-speed compressor 40 and an associated condenser coil 42, which are typically referred to as an "outdoor unit" 44. In various embodiments, the outdoor unit 44 is, for example, a rooftop unit or a ground-level unit. The variable-speed compressor 40 and the associated condenser coil 42 are connected to an associated evaporator coil 30 by a refrigerant line 46. In a typical embodiment, the variable-speed compressor 40 is, for example, a single-stage compressor, a multi-stage compressor, a single-speed compressor, or a variable-speed compressor. Also, as will be discussed in more detail below, in various embodiments, the variable-speed compressor 40 may be a compressor system including at least two compressors of the same or different capacities. The variable-speed circulation fan 10, sometimes referred to as a blower, is configured to operate at different capacities (i.e., variable motor speeds) to circulate air through the HVAC system 1, whereby the circulated air is conditioned and supplied to the enclosed space 101.

Still referring to FIG. 1A, the HVAC system 1 includes an HVAC controller 50 that is configured to control operation of the various components of the HVAC system 1 such as, for example, the variable-speed circulation fan 10, the gas heat 20, the electric heat 22, and the variable-speed compressor 40. In some embodiments, the HVAC system 1 can be a zoned system. In such embodiments, the HVAC system 1 includes a zone controller 80, dampers 85, and a plurality of environment sensors 60. In a typical embodiment, the HVAC controller 50 cooperates with the zone controller 180 and the dampers 185 to regulate the environment of the enclosed space.

The HVAC controller 50 may be an integrated controller or a distributed controller that directs operation of the HVAC system 1. In a typical embodiment, the HVAC controller 50 includes an interface to receive, for example, thermostat calls, temperature setpoints, blower control signals, environmental conditions, and operating mode status for various zones of the HVAC system 1. In a typical embodiment, the HVAC controller 50 also includes a processor and a memory to direct operation of the HVAC system 1 including, for example, a speed of the variable-speed circulation fan 10.

Still referring to FIG. 1A, in some embodiments, the plurality of environment sensors 60 is associated with the HVAC controller 50 and also optionally associated with a user interface 70. In some embodiments, the user interface 70 provides additional functions such as, for example, operational, diagnostic, status message display, and a visual interface that allows at least one of an installer, a user, a support entity, and a service provider to perform actions with respect to the HVAC system 1. In some embodiments, the user interface 70 is, for example, a thermostat of the HVAC system 1. In other embodiments, the user interface 70 is associated with at least one sensor of the plurality of environment sensors 60 to determine the environmental condition information and communicate that information to the user. The user interface 70 may also include a display, buttons, a microphone, a speaker, or other components to communicate with the user. Additionally, the user interface 70 may include a processor and memory that is configured to receive user-determined parameters, and calculate operational parameters of the HVAC system 1 as disclosed herein.

In a typical embodiment, the HVAC system 1 is configured to communicate with a plurality of devices such as, for example, a monitoring device 56, a communication device 55, and the like. In a typical embodiment, the monitoring device 56 is not part of the HVAC system. For example, the monitoring device 56 is a server or computer of a third party such as, for example, a manufacturer, a support entity, a service provider, and the like. In other embodiments, the monitoring device 56 is located at an office of, for example, the manufacturer, the support entity, the service provider, and the like.

In a typical embodiment, the communication device 55 is a non-HVAC device having a primary function that is not associated with HVAC systems. For example, non-HVAC devices include mobile-computing devices that are configured to interact with the HVAC system 1 to monitor and modify at least some of the operating parameters of the HVAC system 1. Mobile computing devices may be, for example, a personal computer (e.g., desktop or laptop), a tablet computer, a mobile device (e.g., smart phone), and the like. In a typical embodiment, the communication device 55 includes at least one processor, memory and a user interface, such as a display. One skilled in the art will also understand that the communication device 55 disclosed herein includes other components that are typically included in such devices including, for example, a power supply, a communications interface, and the like.

The zone controller 80 is configured to manage movement of conditioned air to designated zones of the enclosed space. Each of the designated zones include at least one conditioning or demand unit such as, for example, the gas heat 20 and at least one user interface 70 such as, for example, the thermostat. The zone-controlled HVAC system 1 allows the user to independently control the temperature in the designated zones. In a typical embodiment, the zone controller 80 operates electronic dampers 85 to control air flow to the zones of the enclosed space.

In some embodiments, a data bus 90, which in the illustrated embodiment is a serial bus, couples various components of the HVAC system 1 together such that data is communicated therebetween. In a typical embodiment, the data bus 90 may include, for example, any combination of hardware, software embedded in a computer readable medium, or encoded logic incorporated in hardware or otherwise stored (e.g., firmware) to couple components of the HVAC system 1 to each other. As an example and not by way of limitation, the data bus 90 may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus 90 may include any number, type, or configuration of data buses 90, where appropriate. In particular embodiments, one or more data buses 90 (which may each include an address bus and a data bus) may couple the HVAC controller 50 to other components of the HVAC system 1. In other embodiments, connections between various components of the HVAC system 1 are wired. For example, conventional cable and contacts may be used to couple the HVAC controller 50 to the various components. In some embodiments, a wireless connection is employed to provide at least some of the connections between components of the HVAC system such as, for example, a connection between the HVAC controller 50 and the variable-speed circulation fan 10 or the plurality of environment sensors 60.

Figure 1B:
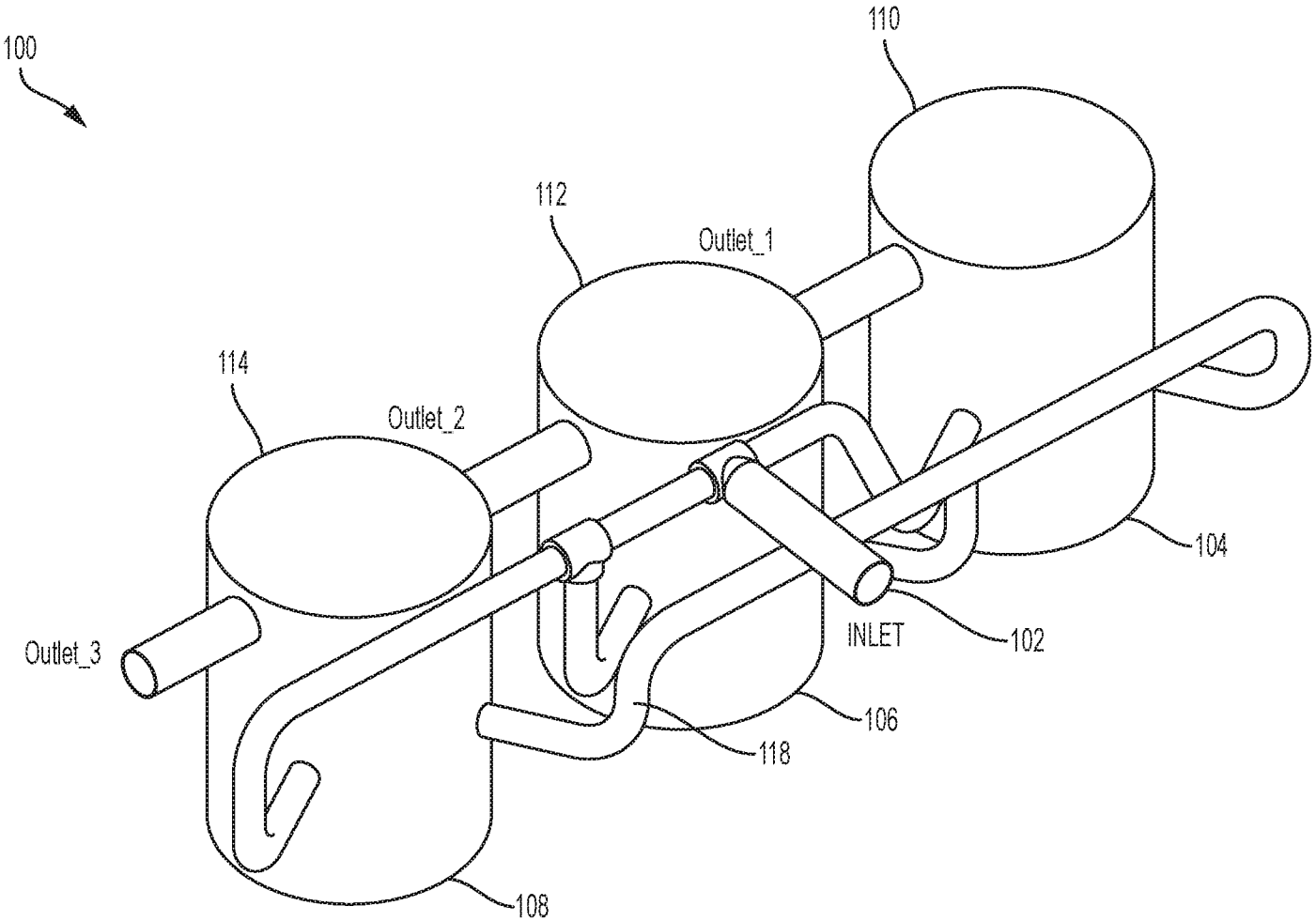
FIG. 1B is a perspective view of a current plumbing assembly for a triple-compressor arrangement.

FIG. 1B is a perspective view of a current plumbing assembly 100 for a triple-compressor arrangement. The plumbing assembly 100 includes an inlet pipe 102, a first outlet 104, a second outlet 106, and a third outlet 108. The first outlet 104, the second outlet 106, and the third outlet 108 are fluidly coupled to a first compressor 110, a second compressor 112, and a third compressor 114, respectively. A suction equalizing tube 118 is fluidly coupled to the first compressor 110, the second compressor 112, and the third compressor 114.

FIG. 1C is a table illustrating performance data associated with the plumbing assembly 100. For purposes of discussion, FIG. 1C is described herein relative to FIG. 1B. The data presented in FIG. 1C illustrates a scenario where the first compressor 110, the second compressor 112, and the third compressor 114 are each operating at full load. During operation, when a constant and equal mass flow rate is enforced across the first outlet 104, the second outlet 106, and the third outlet 108, the first outlet 104 exhibits a smaller pressure drop than the second outlet 106 and the third outlet 108. FIG. 1C also illustrates a maldistribution value associated with the first outlet 104, the second outlet 106, and the third outlet 108. "Maldistribution value" is a measurement that illustrates a degree of fluid-flow balance between the first outlet 104, the second outlet 106, and the third outlet 108 when a constant pressure drop is enforced. Maldistribution value is calculated according to Equation 1.

$$m = \frac{m_1 - m_{av}}{m_{av}} \qquad \text{Equation 1}$$

Where m is the maldistribution value, $m_l$ is the mass flow rate at a particular outlet, and $m_{av}$ is the ideal mass flow rate in the case of uniform flow. Thus, uniform fluid distribution between the first outlet 104, the second outlet 106, and the third outlet 108 will result in a maldistribution value of 0.

FIG. 1D is a table illustrating compressor fluid levels at various start conditions associated with the plumbing assembly 100. The data shown in FIG. 1D illustrates the first compressor 110, the second compressor 112, and the third compressor 114 operating at full load. FIG. 1D specifies the compressor start order. For example, a start order of "123" indicates that the first compressor 110 is activated, then the second compressor 112 is activated, and then the third compressor 114 is activated. A start order of "213" indicates that the second compressor 112 is activated, then the first compressor 110 is activated, and then the third compressor 114 is activated. FIG. 1D demonstrates that the greater pressure drop associated with the second outlet 106 results in greater fluid accumulation in the second compressor 112 than in the first compressor 110 and the third compressor 114 regardless of the start order of the compressors. Such fluid imbalance between the first compressor 110, the second compressor 112, and the third compressor 114 can result in inadequate lubrication for the compressors. Inadequate lubrication results when a fraction of lubricant leaves a compressor with the refrigerant fluid and does not return to the compressor. Thus, fluid imbalance between compressors can also result in disproportionate lubricant distribution. Inadequate lubrication of compressors can adversely impact performance, efficiency, and lifespan of the compressors.

Figure 2:
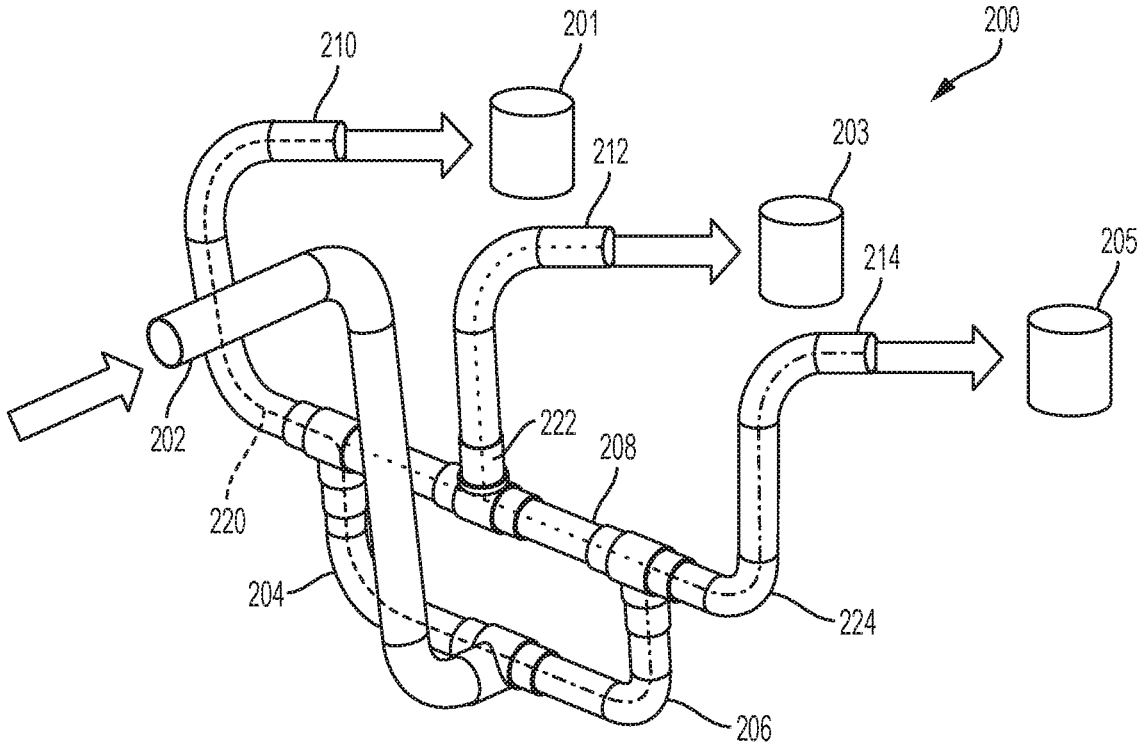
FIG. 2 is a perspective view of an exemplary plumbing assembly for a multi-compressor arrangement.

FIG. 2 is a perspective view of a plumbing assembly 200 for a multi-compressor arrangement. FIG. 2 illustrates an exemplary plumbing assembly that facilitates connection to three equal-capacity compressors; however, in other embodiments plumbing assemblies utilizing principles of the invention could be utilized to facilitate connection to any number of compressors or could be utilized to facilitate connection to unequal capacity compressors. The plumbing assembly includes an inlet 202. The inlet 202 is fluidly coupled to a first main branch 204 and a second main branch 206. The first main branch 204 and the second main branch 206 are fluidly coupled to a distribution section 208. The distribution section 208 includes a first outlet 210, a second outlet 212, and a third outlet 214. In this manner, a first flow path 220 is defined between the inlet 202 and the first outlet 210, a second flow path 222 is defined between the inlet 202 and the second outlet 212, and a third flow path 224 is defined between the inlet 202 and the third outlet 214. In a typical embodiment, the first outlet 210, the second outlet 212, and the third outlet 214 are connected to a first compressor 201, a second compressor 203, and a third compressor 205, respectively. In a typical embodiment, the first compressor 201, the second compressor 203, and the third compressor 205 are parallel-connected single-stage compressors having approximately equal capacity; however, in other embodiments, plumbing assemblies utilizing principles of the invention may include any type of compressors including, for example, compressors having multiple stages and compressors of unequal capacities.

Still referring to FIG. 2, the distribution section 208 is arranged such that the second outlet 212 is positioned between the first main branch 204 and the second main branch 206. The first outlet 210 is positioned towards an outside of the first main branch 204 and the third outlet 214 is positioned to an outside of the second main branch 206. Thus, in a typical embodiment, the second flow path 222 is longer than the first flow path 220 and the third flow path 224. In a typical embodiment, a longer flow path between the inlet 202 and the second outlet 212 causes fluid flow in the second flow path 222 to be restricted and results in additional pressure loss at the second outlet 212. Such additional pressure loss at the second outlet 212 causes a desired pressure differential between the first outlet 210, the second outlet 212, and the third outlet 214. In embodiments where the first compressor 201, the second compressor 203, and the third compressor 205 are of approximately equal capacity, the pressure drop at the first outlet 210, the second outlet 212, and the third outlet 214 is approximately equal.

Figures 3, 4:
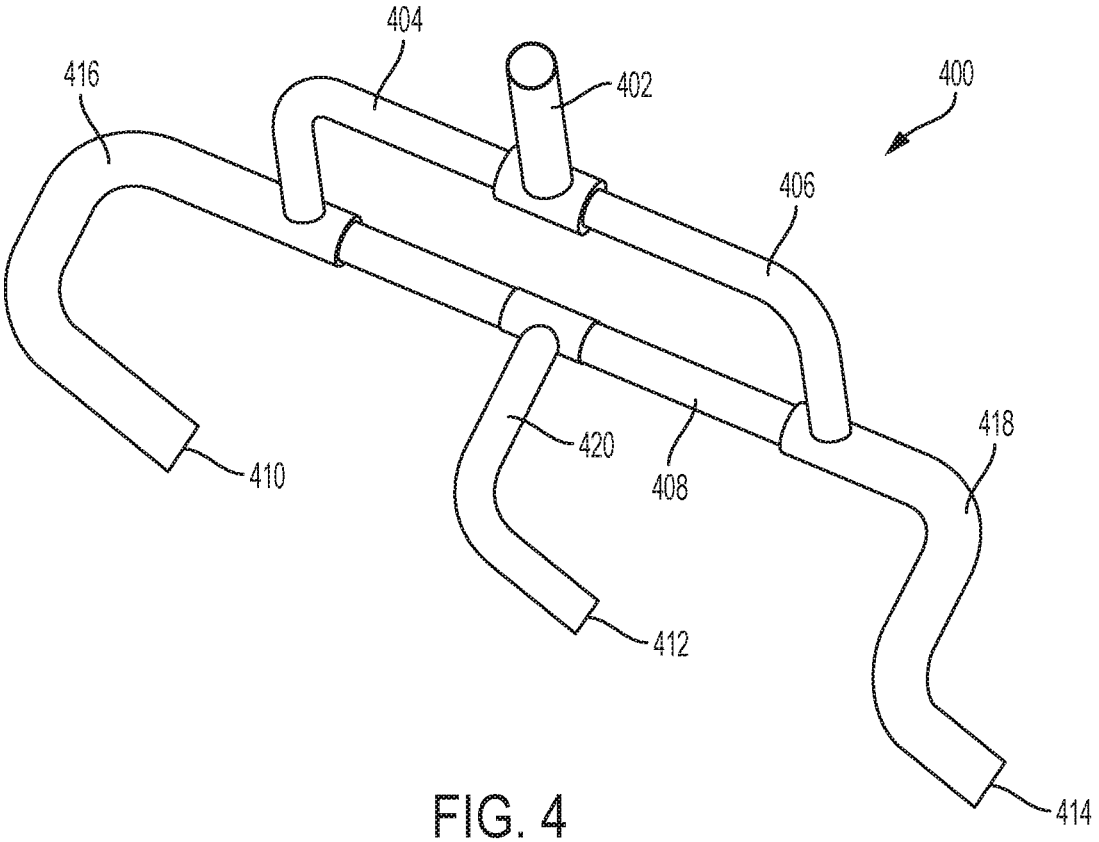
FIG. 3 is a table illustrating maldistribution and pressure drop associated with the exemplary plumbing assembly of FIG. 2.
FIG. 4 is a schematic diagram of an alternative plumbing assembly for a multi-compressor arrangement according to an exemplary embodiment.

FIG. 3 is a table illustrating pressure drop associated with the plumbing assembly 200. For purposes of discussion, FIG. 3 is described herein relative to FIG. 2. The data presented in FIG. 3 illustrates a unique case where the capacities of the first compressor 201, the second compressor 203, and the third compressor 205 are equal and also illustrates the situation when all compressors are operating at full load. By way of example and as illustrated in FIG. 3, the plumbing assembly 200 restricts fluid flow in the second flow path 222 thereby causing the pressure drop at the first outlet 210, the second outlet 212, and the third outlet 214 to be within approximately 0.5 lbs/in$^2$ of each other. Thus, the plumbing assembly 200 creates a pressure differential between the first outlet 210, the second outlet 212, and the third outlet 214 that facilitates maintenance of a prescribed fluid level in the first compressor 201, the second compressor 203, and the third compressor 205.

FIG. 4 is a schematic diagram of an alternative plumbing assembly 400. For purposes of discussion, FIG. 4 is described herein relative to FIGS. 2-3. FIG. 4 illustrates a plumbing assembly that facilitates connection to three compressors of unequal capacity (e.g. compressors connecting the first outlet 410 and the third outlet 414 are of equal capacity and greater in capacity to the compressor connecting the second outlet 412); however, in other embodiments plumbing assemblies utilizing principles of the invention could be utilized to facilitate connection to any number of compressors. The plumbing assembly 400 includes an inlet 402. The inlet 402 is fluidly coupled to a first main branch 404 and a second main branch 406. A distribution section 408 is coupled to the first main branch 404 and the second main branch 406. The distribution section 408 includes a first outlet 410, a second outlet 412, and a third outlet 414. In a typical embodiment, the alternative plumbing assembly 400 illustrates a tubing section 416 fluidly coupled to the first outlet 410 and a tubing section 418 fluidly coupled to the third outlet 414 that are of a larger inner diameter than a tubing section 420 that is fluidly coupled to the second outlet 412. Additionally, the tubing section 416 and the tubing section 418 include a larger number of bends than the tubing section 420. The increased diameter of the tubing section 416 and the tubing section 418 causes fluid flow to the second outlet 412 to be restricted when compared to fluid flow to the first outlet 410 and the third outlet 414. Such an arrangement facilitates creation of the desired pressure differential between the first outlet 410, the second outlet 412, and the third outlet 414.

In a typical embodiment, the alternative plumbing assembly 400 creates a pressure differential between the first outlet 410, the second outlet 412, and the third outlet 414 that facilitates maintenance of a prescribed liquid level in the first compressor 201, the second compressor 203, and the third compressor 205. In various embodiments, features such as tubing diameter, number of tubing bends, or flow restrictors can be utilized to create the desired pressure differential.

Figure 5:
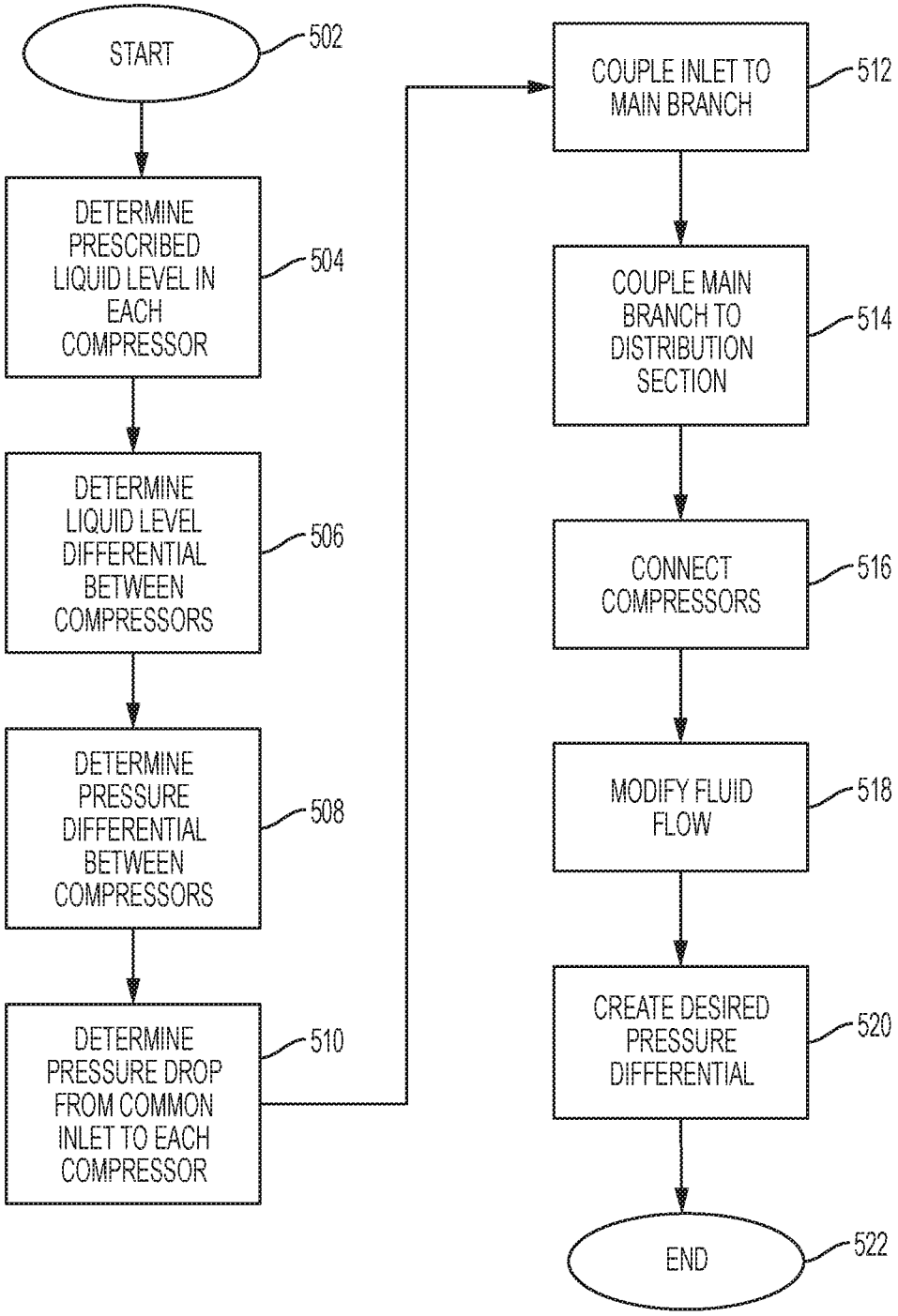
FIG. 5 is a flow diagram of an exemplary process for distributing fluid in a multi-compressor system.

FIG. 5 is a flow diagram of a process 500 for distributing fluid in a multi-compressor system. For purposes of discussion, FIG. 5 is described herein relative to FIGS. 2-4. The process 500 starts at step 502. At step 504, a prescribed liquid level is determined for each compressor. In a typical embodiment, the liquid level is a factory-prescribed parameter. At step 506, a liquid-level differential between each pair of compressor is determined. For example, in a three-compressor system, a liquid-level differential is determined between the first compressor 201 and the second compressor 203, between the second compressor 203 and the third compressor 205, and the first compressor 201 and the third compressor 205. At step 508, a pressure differential that corresponds to the liquid-level differences is calculated. At step 510, a pressure drop from the inlet 202 to each compressor is determined.

At step 512, an inlet 102 is fluidly coupled to a main branch. For example, in a three compressor system, the inlet 202 is fluidly coupled to a first main branch 204 and a second main branch 206. At step 514, a distribution section 208 is fluidly coupled to the main branch. For example, in a three compressor system the distribution section 208 is fluidly coupled to the first main branch 204 and the second main branch 206. At step 516, compressors are coupled to the distribution section 208. For example, in a three-compressor system, the first compressor 201, the second compressor 203, and the third compressor 205 are fluidly coupled to the first outlet 210, the second outlet 212, and the third outlet 214 of the distribution section 208, respectively. Thus, a first flow path 220 is defined between the inlet 102 and the first outlet 210, a second flow path 222 is defined between the inlet 102 and the second outlet 212, and a third flow path 224 is defined between the inlet 102 and the third outlet 214. At step 518, fluid flow through each branch is modified to achieve the pressure differentials calculated in step 506. For example, in a three-compressor system, fluid flow through the second flow path 222 is restricted relative to the first flow path 220 and the third flow path 224.

Step 518 is repeated to create the desired pressure differential to each compressor. At step 520, modification of the fluid flow through each branch creates a desired differential pressure between each compressor and facilitates maintenance of a prescribed liquid level in each compressor. In a typical embodiment, pressure drop proportional to compressor capacity leads to prescribed liquid levels in the first compressor 201, the second compressor 203, and the third compressor 205 thereby enhancing efficiency and service life of the first compressor 201, the second compressor 203, and the third compressor 205. The process 500 ends at step 522.

Depending on the embodiment, certain acts, events, or functions of any of the algorithms described herein can be performed in a different sequence, can be added, merged, or left out altogether (e.g., not all described acts or events are necessary for the practice of the algorithms). Moreover, in certain embodiments, acts or events can be performed concurrently, e.g., through multi-threaded processing, interrupt processing, or multiple processors or processor cores or on other parallel architectures, rather than sequentially. Although certain computer-implemented tasks are described as being performed by a particular entity, other embodiments are possible in which these tasks are performed by a different entity.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, the processes described herein can be embodied within a form that does not provide all of the features and benefits set forth herein, as some features can be used or practiced separately from others. The scope of protection is defined by the appended claims rather than by the foregoing description. All changes which come within the meaning and range of equivalency of the claims are to be embraced within their scope.

What is claimed is:

1. A compressor system comprising:

at least two compressors;

a suction equalizing tube fluidly coupling the at least two compressors;

a plumbing assembly fluidly coupled to the at least two compressors, the plumbing assembly comprising:

an outlet to each compressor of the at least two compressors;

an inlet tube fluidly coupled to a first main branch and a second main branch;

a distribution section fluidly coupled to the first main branch and the second main branch, the distribution section comprising a first outlet, a second outlet, and a third outlet, such that a first flow path is defined between the inlet tube and the first outlet, a second flow path is defined between the inlet tube and the second outlet, and a third flow path is defined between the inlet tube and the third outlet, the first outlet, the second outlet, and the third outlet being fluidly coupled to the first compressor, the second compressor, and a third compressor, respectively;

wherein the second flow path is longer than the first flow path and the third flow path causing fluid flow in the second flow path to be restricted resulting in creation of a pressure differential between the at least two compressors; and wherein the pressure differential maintains a desired fluid level in the at least two compressors.

2. The compressor system of claim 1, wherein a flow resistance in at least one of the first flow path, the second flow path, and the third flow path is altered by at least one of changing a flow-path length, changing a flow-path diameter, or varying a number of bends.

3. The compressor system of claim 1, wherein at least one of the first flow path and the third flow path includes a greater number of bends than the second flow path.

4. The compressor system of claim 1, wherein a pressure differential between the first compressor, the second compressor, and the third compressor results in a prescribed liquid level being maintained in the first compressor, the second compressor, and the third compressor.

5. The compressor system of claim 1, wherein the at least two compressors are of approximate equal capacity.

6. A plumbing assembly comprising:

an inlet tube;

a first main branch fluidly coupled to the inlet tube;

a second main branch fluidly coupled to the inlet tube;

a distribution section fluidly coupled to the first main branch and to the second main branch, the distribution section comprising:

a first outlet;

a second outlet;

a third outlet;

wherein a first flow path is defined between the inlet tube and the first outlet, a second flow path is defined between the inlet tube and the second outlet, and a third flow path is defined between the inlet tube and the third outlet; and wherein the second flow path is longer than the first flow path and the third flow path causing fluid flow in the second flow path to be restricted resulting in creation of a desired pressure differential between first outlet, the second outlet, and the third outlet.

7. The plumbing assembly of claim 6, wherein the first outlet is fluidly coupled to a first compressor, the second outlet is fluidly coupled to a second compressor, and the third outlet is fluidly coupled to a third compressor.

8. The plumbing assembly of claim 7, wherein the first compressor, the second compressor, and the third compressor are of approximately equal capacity.

9. The plumbing assembly of claim 7, wherein pressure drop across the first flow path, the second flow path, and the third flow path is approximately equal.

10. The plumbing assembly of claim 6, wherein a flow resistance in at least one of the first flow path, the second flow path, and the third flow path is varied to accommodate varying compressor capacity.

11. The plumbing assembly of claim 6, wherein liquid flow is distributed from the inlet tube between the first main branch and the second main branch and then to the distribution section.

12. A method of equalizing pressure in a multi-compressor system, the method comprising:

coupling an inlet tube to a main branch;

coupling a distribution section to the main branch;

coupling at least two compressors to the distribution section through at least a first outlet and a second outlet, respectively, the first outlet defining a first flow path between an inlet and the first outlet and the second outlet defining a second flow path between the inlet and the second outlet; and wherein the second flow path is longer than the first flow path causing fluid flow in the second flow path to be restricted resulting in creation of a pressure differential between the first flow path and the second flow path; and wherein the pressure differential maintains a desired liquid level in the at least two compressors.

13. The method of claim 12, wherein the at least two compressors are of approximately equal capacity.

14. The method of claim 13, wherein pressure drops in the first flow path and the second flow path are approximately equal.

15. The method of claim 12, wherein a flow resistance of at least one of the first flow path and the second flow path is altered by at least one of changing a flow-path length, changing a flow-path diameter, or varying a number of bends.

* * * * *